United States Patent [19]

Tischer

[11] Patent Number: 4,864,189

[45] Date of Patent: Sep. 5, 1989

[54] CONTROL PLATE FOR DISPLAY DEVICES

[75] Inventor: Kurt M. Tischer, Wendlingen, Fed. Rep. of Germany

[73] Assignee: Nokia Graetz GmbH, Stuttgart, Fed. Rep. of Germany

[21] Appl. No.: 169,404

[22] Filed: Mar. 17, 1988

[30] Foreign Application Priority Data

Mar. 18, 1987 [DE] Fed. Rep. of Germany ..... 3708798

[51] Int. Cl.[4] ..... H01J 29/50

[52] U.S. Cl. ..... 313/422; 313/497

[58] Field of Search ..... 313/422, 491, 497, 103 CM, 313/105 CM, 355, 583

[56] References Cited

U.S. PATENT DOCUMENTS 4,560,898 12/1985 Knapp et al. ..... 313/103 CM X
4,721,880 1/1988 Mansell et al. ..... 313/103 CM X
4,745,332 5/1988 Tischer ..... 313/422

*Primary Examiner*—Donald J. Yusko
*Assistant Examiner*—Sandra L. O'Shea
*Attorney, Agent, or Firm*—Peter C. Van Der Sluys

[57] ABSTRACT

Control plates in flat display devices are located between the cathode and the screen and serve to control the electron flow. To permit easy contacting even if the conductors (1) of the control plates are very narrow, the conductors (1) alternately have broadened ends on opposite sides of the control plate. The ends are broader by the width of the respective adjacent conductor.

6 Claims, 1 Drawing Sheet

CONTROL PLATE FOR DISPLAY DEVICES

BACKGROUND OF THE INVENTION

1. Field of the Invention

The invention relates to a control plate for a flat display device. The control plate is formed by a layer of metal conductors which has openings arranged in a regular pattern.

2. Description of the Prior Art

In an article by W. C. Holton et al, "Design, Fabrication, and Performance of a Flat Tube Display" (1977 International Electron Devices Meeting, Washingotn, D.C.; IEEE): 78–80, a flat display device is described which has a multilayer control ("switching") stack. The control stack is located between a cathode and a screen and serves to control the electron flow. The control stack consists of control plates ("subassemblies"), each of which is formed by a layer of metal conductors, between which a metallic matrix-hole plate is located. The individual control plates are arranged at right angles to each other, and at the points of intersection of the conductors, there are elliptic holes in the conductors which are flush with the holes in the matrix-hole plate. The conductors and the matrix-hole plate are frit-bonded together and held in a given spaced relationship. Several such control plates are assembled to form the switching stack.

In high-resolution display devices, including those using electron-beam deflection, the distances between the openings in the conductors must be small. As a result, the conductors are very narrow and have only small contact areas at their ends.

SUMMARY OF THE INVENTION

It is therefore the object of the invention to provide a control plate which permits easier contacting of the individual conductors.

This object is achieved by using parallel conductors, each conductor having a broad end and a narrow end, the broadened ends of adjacent conductors being disposed on opposite sides of the control plate, with the broadened ends of each conductor extending across the width of the conductor to which it is attached and across at least a portion of the width of a longitudinal projection of the width of at least one adjacent conductor. An advantageous development of the invention is that openings in the adjacent conductors are staggered with respect to each other.

The broadened ends of the conductor permit easy contacting. If the ends of the conductors are more than one millimeter wide, even soft-soldering is readily possible.

DESCRIPTION OF THE DRAWINGS

Embodiments of the invention will now be explained in more detail with reference to the accompanying drawings, in which.

DESCRIPTION OF THE INVENTION

Figure 1:
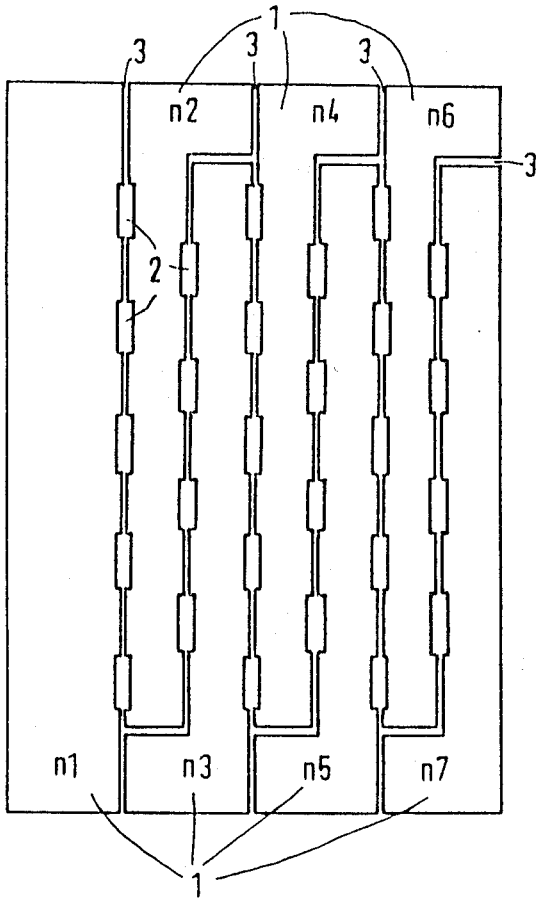
FIG. 1 is a top view of the conductors of a first embodiment of a control plate.

The control plates shown in the drawings are intended for use in a flat display device (not shown) and serve to control the electron flow between the cathode and the screen.

The control plate shown in FIG. 1 is formed by a layer of conductors 1 which are parallel to each other. Each conductor 1 has one end that is broadened, and the broadened ends adjacent conductors in the control plate are disposed at opposite sides of the control plate. The broadened end of each conductor extends across the width of the conductor to which it is attached and the width of a longitudinal projection of the width of an adjacent conductor. Openings 2 spaced at regular intervals are formed by recesses in adjacent conductors 1, in other words: the isolating interstice 3 between the condutors 1 runs through the center of the openings 2. The openings 2 are staggered with respect to each other. They have the shape of a rectangle whose short sides are transverse to the isolating interstices 3. For the sake of clarity, only seven conductors 1 are shown. The number of the conductors and the shape of the openings are not essential to the invention but depend only on the structure of the display device.

If the conductors in FIG. 1 are numbered n1 to n7 from left to right, the broadened ends of the odd-numbered conductors are located at the lower edge of the control plate, and the broadened ends of the even-numbered conductors at the upper edge. This arrangement makes it possible to broaden one end of each of the conductors by the width of the respective adjacent conductor and provide a larger area for making contact to the conductors.

Figure 2:
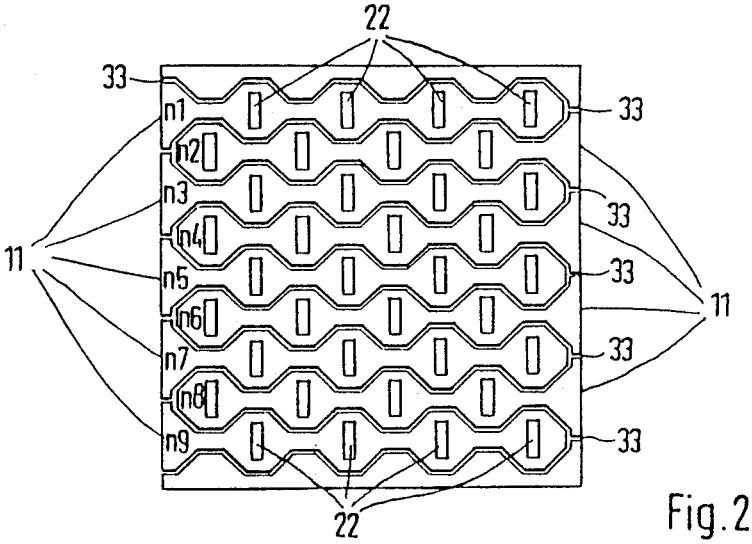
FIG. 2 is a top view of the conductors of a second embodiment of a control plate.

The control plate shown in FIG. 2 is formed by a layer of conductors 11 which are parallel to each other. Each conductor 11 has a broadened end and a narrow end. The broadened ends of adjcent conductors in the control plate are disposed at opposite sides of the control plate. The broadened end of each conductor extends across the width of the conductor to which it is attached and one-half the width of the longitudinal projections of the widths of each of the adjacent conductors. Here, too, regularly spaced openings 22 are present, but they are located in the conductors 11, i.e., the isolating interstices 33 do not run through the the openings 22. Here, too, the openings 22 are staggered with respect to each other and have the shape of a rectangle whose long sides are transverse to the isolating interstices 33. For the sake of clarity, only nine conductors 11 are shown. Here, too, the number of the conductors and the shape of the openings are not essential to the invention.

If the conductors in FIG. 2 are numbered n1 to n9 from top to bottom, the broadened ends of the odd-numbered ends of the conductors are located at the left edge of the control plate, and the broadened ends of the even-numbered conductors are located at the right edge. This makes it possible to broaden the ends of the conductors in such a way that they also extend across one-half the widths of longitudinal projections of the widths of the respective two adjacent conductors and provide a larger area for making contact to the conductors.

The control plates are manufactured in the usual way. Two or more are combined in a known manner to form a control structure for a flat display device.

I claim:

1. A control plate for a flat display device formed by a layer of metal conductors disposed adjacent each other and extending in a longitudinal direction, said layer having openings arranged in a regular pattern, wherein the improvement comprises, the conductors being formed with a broadened end, the broadened ends of adjacent conductors being disposed on opposite sides of the control plate.

2. A control plate as described in claim 1, wherein the broadened ends of the conductors extend across at least a portion of a longitudinal projection of the width of at least one adjacent conductor.

3. A control plate as described in claim 2, wherein the broadened ends of the conductors extend across the entire width of a longitudinal projection of the width of one adjacent conductor.

4. A control plate as described in claim 2, wherein the broadened ends of the conductors extend across at least a portion of the longitudinal projections of the width of two adjacent conductors.

5. A control plate as described in claim 2, wherein the broadened ends of the conductors extend across one-half the width of the longitudinal projections of the width of two adjacent conductors.

6. A control plate as described in claim 1, wherein the openings associated with adjacent conductors are staggered with respect to each other.

* * * * *